US009714794B2

(12) United States Patent
Ninagawa et al.

(10) Patent No.: US 9,714,794 B2
(45) Date of Patent: Jul. 25, 2017

(54) HEAT EXCHANGER TUBE HAVING FINS WITH VARYING LOUVER INCLINATION ANGLE

(71) Applicant: DENSO CORPORATION, Kariya, Aichi-pref. (JP)

(72) Inventors: Toshihide Ninagawa, Chita (JP); Nobuhiro Honma, Chiryu (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 422 days.

(21) Appl. No.: 13/834,563

(22) Filed: Mar. 15, 2013

(65) Prior Publication Data

US 2013/0248150 A1 Sep. 26, 2013

(30) Foreign Application Priority Data

Mar. 22, 2012 (JP) ..... 2012-064941

(51) Int. Cl.
*F28D 1/00* (2006.01)
*F28F 1/32* (2006.01)
(Continued)

(52) U.S. Cl.
CPC ..... *F28F 1/325* (2013.01); *F28D 1/05366* (2013.01); *F28F 1/128* (2013.01); *F28F 2225/04* (2013.01)

(58) Field of Classification Search
CPC ..... F28F 1/128; F28F 1/325; F28F 2225/04; F28F 2215/04; F28F 2215/08; F28F 1/10;
(Continued)

(56) References Cited

U.S. PATENT DOCUMENTS 4,332,293 A * 6/1982 Hiramatsu ..... 165/153
5,035,052 A * 7/1991 Suzuki et al. ..... 29/890.046
(Continued)

FOREIGN PATENT DOCUMENTS

JP U-05-45474 6/1993
JP 2005-003350 1/2005
(Continued)

OTHER PUBLICATIONS

Immediately—definition of immediately by The Free Dictionary. pdf.*
(Continued)

*Primary Examiner* — Etsub Berhanu
*Assistant Examiner* — Jose O Class-Quinones
(74) *Attorney, Agent, or Firm* — Harness, Dickey & Pierce, P.L.C.

(57) ABSTRACT

A fin for a heat exchanger includes a flat portion having an upstream flat part and a downstream flat part parallel to a flow direction of a fluid. Multiple louvers are arranged in the flow direction. A fluid-turning part including a surface approximately parallel to the flow direction is arranged between two of the multiple louvers. A first portion of the louvers located upstream of the fluid-turning part are inclined in a direction opposite from a second portion of the louvers located downstream of the fluid-turning part. The first and second portion of the louvers include first louvers and second louvers. The first louvers are inclined from the flat portion at a first inclined angle larger than a second inclined angle at which the second louvers are inclined from the flat portion. The second louvers are arranged adjacent to the fluid-turning part.

13 Claims, 9 Drawing Sheets

(51) Int. Cl.
*F28D 1/053* (2006.01)
*F28F 1/12* (2006.01)

(58) Field of Classification Search
CPC ..... F28F 1/12; F28F 1/14; F28F 1/38; F28F 1/24; F28F 1/30; F28F 1/32; F28F 1/42; F28F 3/027; F28F 2275/12; F28D 1/05366; F28D 1/053; F28D 1/05391
USPC ..... 165/148, 151–153, 179, 181–183; 29/890.045, 890.047
See application file for complete search history.

(56) References Cited

U.S. PATENT DOCUMENTS 5,271,458 A * 12/1993 Yamamoto et al. ..... 165/152
5,509,469 A * 4/1996 Obosu ..... 165/151
5,730,214 A 3/1998 Beamer et al.
6,170,565 B1 * 1/2001 Nishishita ..... 165/140
6,543,527 B1 * 4/2003 Bouzida et al. ..... 165/152
6,805,193 B2 10/2004 Hu et al.
7,413,002 B2 * 8/2008 Ninagawa ..... F28F 1/128 165/151
2003/0136554 A1 * 7/2003 Hu et al. ..... 165/151
2005/0077036 A1 * 4/2005 Antonijevic ..... 165/182
2007/0029074 A1 * 2/2007 Helms et al. ..... 165/152
2007/0051502 A1 3/2007 Yamauchi
2008/0121385 A1 * 5/2008 Kim ..... 165/151
2008/0190588 A1 * 8/2008 Heidenreich et al. ..... 165/151
2009/0223656 A1 9/2009 Hiyama et al.
2010/0243226 A1 * 9/2010 Huazhao et al. ..... 165/182

FOREIGN PATENT DOCUMENTS

JP 2006-337005 12/2006
JP 2007-212009 8/2007
JP 2008-309373 12/2008
JP B2-4690605 6/2011

OTHER PUBLICATIONS

Office Action issued Feb. 24, 2015 in corresponding JP Application No. 2012-64941 (with English translation).

* cited by examiner

HEAT EXCHANGER TUBE HAVING FINS WITH VARYING LOUVER INCLINATION ANGLE

CROSS REFERENCE TO RELATED APPLICATION

This application is based on and incorporates herein by reference Japanese Patent Application No. 2012-064941 filed on Mar. 22, 2012.

TECHNICAL FIELD

The present disclosure relates to a fin and a heat exchanger including the fin.

BACKGROUND

Conventionally, a fin for a heat exchanger has multiple louvers on a surface of the fin, and the louvers are arranged in an air flow direction. The louvers are provided by cutting the fin and raising the cut part of the fin. A variety of technologies have been proposed for, improvement of a heat exchange capacity of the fin by changing shapes of the louvers, such as a length and an inclined angle of the cut part of the fin (e.g., refer to Patent Document 1 (JP 4690605 B2), Patent Document 2 (U.S. Pat. No. 5,730,214 A), Patent Document 3 (JP 2005-003350 A corresponding to US 2007/0051502A1) and Patent Document 4 (JP 5-045474 U)).

A fin for a heat exchanger described in Patent Document 1 includes a changing part provided at a center part of the fin in an air flow direction, and the air flow direction is changed at the changing part. The fin has downstream louvers located downstream of the changing part, and upstream louvers located upstream of the changing part in the air flow direction. The downstream louvers are inclined from a surface of the fin at an angle smaller than that of the upstream louvers.

A fin for a heat exchanger described in Patent Document 2 includes a changing part, upstream louvers and downstream louvers, similarly to Patent Document 1. The upstream louvers are arranged such that inclined angles of thereof are gradually increased in an air flow direction in a steady pattern, and the downstream louvers are arranged such that inclined angles thereof are gradually decreased in the air flow direction in a steady pattern.

In a heat exchanger described in Patent Document 3, long louvers and short louvers are alternatively arranged to improve an efficiency of heat exchange of a fin. In a heat exchanger described in Patent Document 4, a most downstream louver of multiple louvers in an air flow direction has a length longer than that of the other louvers, or is separated from a louver adjacent to the most downstream louver by a distance longer than distances between other two of the multiple louvers.

When a louver pitch is decreased so that the number of louvers is increased in a fin, a heat transfer efficiency of the fin can be increased due to edge effects of the louvers, and a heat exchange capacity of the fin can be thereby increased.

However, when the louver pitch is decreased so that the number of louvers is increased, an airflow resistance of the fin may be increased due to decrease of a total area of louver passages provided between two louvers adjacent to each other. When a heat exchanger provided with the fin is combined with a blower fan that blows air to the heat exchanger, a flow rate of air flowing through the louver passages may decrease, and the heat exchange capacity of the fin may decrease as a result. In other word, even when only the louver pitch made to be short in the fin having multiple louvers, the heat exchange capacity may not be increased.

SUMMARY

It is an objective of the present disclosure to provide a fin and a heat exchanger including the fin, which have a high heat exchange capacity.

According to an aspect of the present disclosure, a fin for a heat exchanger is connected to an outer surface of a heat-exchange object to promote heat exchange between the heat-exchange object and fluid flowing in vicinity of the heat-exchange object. The fin includes a flat portion, a plurality of louvers and a fluid-turning part. The flat portion has a flat shape approximately parallel to a flow direction of the fluid. The plurality of louvers are cut and inclined from the flat portion, and the plurality of louvers are arranged in the flow direction of the fluid. The fluid-turning part is arranged between two of the plurality of louvers adjacent to each other, and the fluid-turning part has a surface approximately parallel to the flow direction of the fluid. The plurality of louvers are separated into an upstream group located upstream of the fluid-turning part in the flow direction of the fluid, and a downstream group located downstream of the fluid-turning part in the flow direction of the fluid. The louvers of the upstream group are inclined from the flat portion in an inclination direction opposite from an inclination direction in which the louvers of the downstream group are inclined from the flat portion. The plurality of the louvers of at least one of the upstream group and the downstream group include at least first louvers and second louvers. The first louvers are inclined from the flat portion at a first inclined angle larger than a second inclined angle at which the second louvers are inclined from the flat portion. The second louvers are arranged adjacent to the fluid-turning part.

Accordingly, a pressure loss generated when a flow direction of the fluid is turned at the fluid-turning part can be reduced, and a flow resistance of the fluid can be reduced. Furthermore, because one of the louvers located immediately downstream of the fluid-turning part in the flow direction of the fluid can be utilized effectively, a heat transfer rate can be increased due to an edge effect of the louver located immediately downstream of the fluid-turning part. As a result, heat radiation capacity is increased, and a heat exchange capacity can be thereby increased.

The second louvers may be larger than the first louvers in louver pitch. Accordingly, a pressure resistance of the second louvers can be increased. Therefore, both the increase of the heat exchange capacity and the securement of the pressure resistance can be achieved.

The first louvers may be approximately equal to the second louvers in louver distance.

According to another aspect of the present disclosure, a heat exchanger includes a tube through which an internal fluid flows, and a fin connected to an outer surface of the tube to promote heat exchange between the internal fluid and an external fluid flowing in vicinity of the tube. The tube includes a pressure resistance part located an inside space of the tube to ensure a pressure resistance of the tube. The fin includes a flat portion and a plurality of louvers. The flat portion has a flat shape approximately parallel to a flow direction of the external fluid. The plurality of louvers are cut and inclined from the flat portion, and the plurality of louvers are arranged in the flow direction of the fluid. The plurality of louvers include at least first louvers and second louvers. The first louvers are inclined from the flat portion at a first inclined angle larger than a second inclined angle at which the second louvers are inclined from the flat portion. The second louvers are arranged at positions corresponding to a position of the pressure resistance part.

Accordingly, a flow resistance of the fluid flowing in a flow passage adjacent to the second louvers can be reduced, and the heat exchange capacity can be increased. By arranging the second louvers at the positions corresponding to the position of the pressure resistance part, a pressure resistance can be ensured as a whole.

The fin may further include a fluid-turning part having a surface approximately parallel to the flow direction of the fluid. The fluid-turning part may be arranged between two of the plurality of louvers adjacent to each other. The plurality of louvers may be separated into an upstream group located upstream of the fluid-turning part in the flow direction of the fluid, and a downstream group located downstream of the fluid-turning part in the flow direction of the fluid. The louvers of the upstream group may be inclined from the flat portion in an inclination direction opposite from an inclination direction in which the louvers of the downstream group are inclined from the flat portion. The second louvers may be arranged adjacent to the fluid-turning part.

The tube may have a flattened shape in its cross-sectional surface perpendicular to a longitudinal direction of the tube. The tube may include two flat walls opposed to each other to be exposed to a flow passage of the tube through which the internal fluid flows. The pressure resistance part may be an inner pole portion which connects the two flat walls inside the tube.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
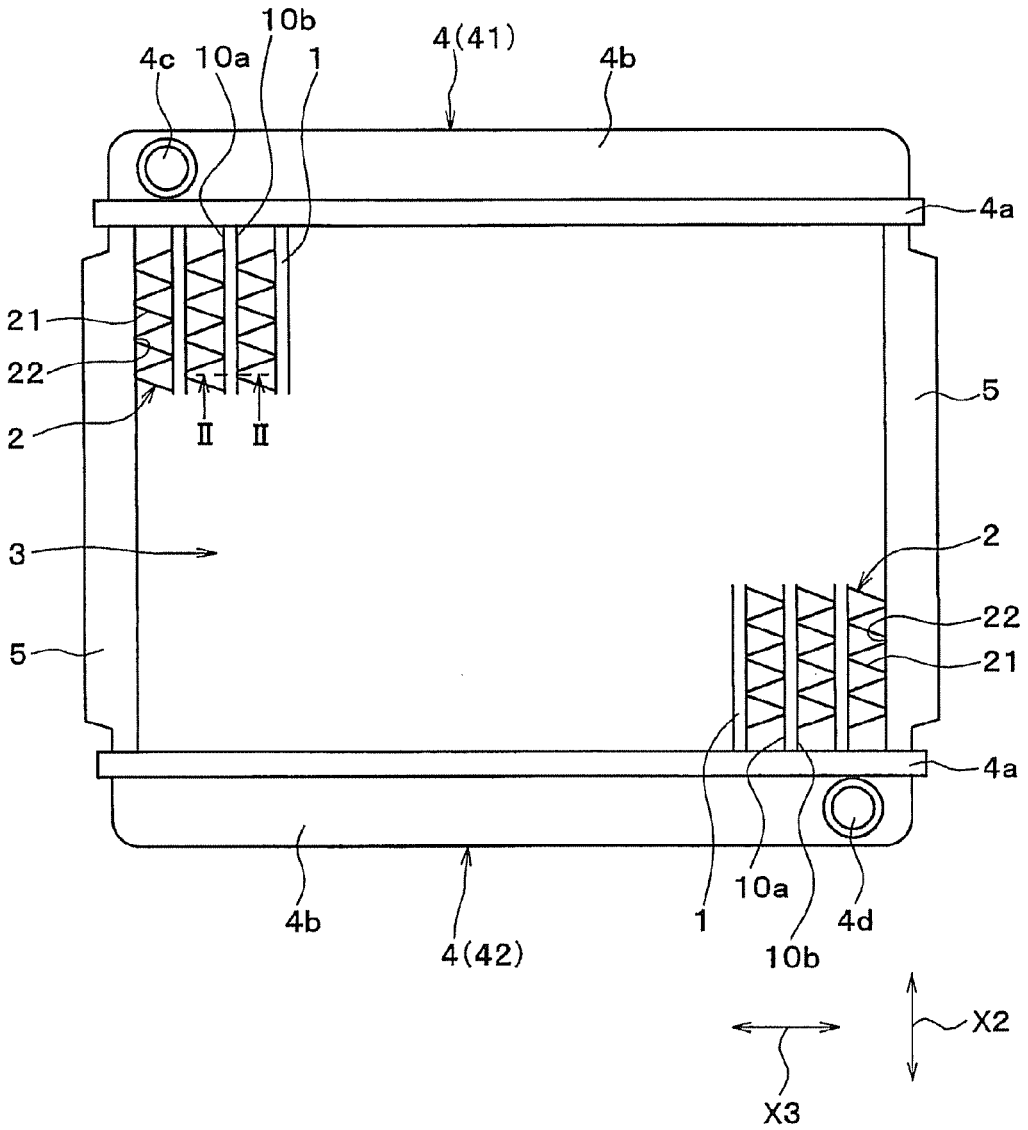
FIG. 1 is a schematic view showing a radiator according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described with reference to FIGS. 1 to 6. In the first embodiment, a heat exchanger of the present disclosure is applied to a radiator that cools an internal combustion engine by using a coolant.

As shown in FIG. 1, the radiator includes tubes 1 through which an internal fluid (e.g., coolant) flows. Each tube 1 has an oval shape (flattened shape) in sectional surface perpendicular to a longitudinal direction X2 of the tube 1, and a longer diameter (i.e., major axis) of the sectional surface is parallel to a flow direction X1 of an external fluid (e.g., air). The tubes 1 are arranged in a first direction to be parallel to one another, and the first direction is perpendicular to the longitudinal direction X2 of the tubes 1 and the air flow direction X1. The first direction is referred to as a tube stacking direction X3. The tube longitudinal direction X2 may be parallel to a vertical direction, and the tube stacking direction X3 may be parallel to a horizontal direction.

Each of the tubes 1 has a pair of flat walls 10*a* and 10*b* (flat surfaces) exposed to a fluid passage of the tube 1 through which the coolant flows, and the flat walls 10*a* and 10*b* are opposed to each other in the tube stacking direction X3 in each tube 1. The flat walls 10*a* and 10*b* may be arranged to be parallel to each other. The radiator further includes fins 2 each of which has a corrugated shape and is provided in an air passage between adjacent two of the tubes 1. Each fin 2 contacts the flat wall 10*a* of one tube 1 on one side of the fin 2 and contacts the flat wall 10*b* of another tube 1 on the other side of the fin 2. The fins 2 are used as heat transfer members that promote heat exchange between the air and the coolant by increasing a heat transfer area therebetween. The tubes 1 may be used as an example of a heat-exchange object which exchanges heat with a fluid flowing in vicinity of the heat-exchange object. The radiator further includes a core portion 3 having an approximately rectangular shape, and the core portion 3 includes the tubes 1 and the fins 2 therein.

The radiator further includes a pair of header tanks 4 located at both end parts of the tubes 1 in the tube longitudinal direction X2. The header tanks 4 extend in the tube stacking direction X3 and communicate with the tubes 1. As shown in FIG. 1, each header tank 4 includes a core plate 4*a* through which the tubes 1 extend to be fixed to the header tank 4, and a tank body portion 4*b* located on a side of the core plate 4*a* opposite from the tubes 1. The core plate 4*a* and the tank body portion 4*b* define an inside space of the header tank 4. In the present embodiment, for example, the core plate 4*a* is made of metal (e.g., aluminum alloy), and the tank body portion 4*b* is made of resin. The radiator further includes a pair of inserts 5 provided in both end parts of the core portion 3 in the tube stacking direction X3, and the inserts 5 extend approximately parallel with the tube longitudinal direction X2 to make the core portion 3 robust.

One of the pair of header tanks 4 which distributes the coolant to the tubes 1 is referred to as an inlet tank 41, and the other of the pair of header tanks 4 which collects the coolant flowing out of the tubes 1 is referred to as an outlet tank 42. As shown in FIG. 1, the inlet tank 41 may be located on an upper side of the core portion 3, and the outlet tank 42 may be located on a lower side of the core portion 3. The tank body portion 4*b* of the inlet tank 41 includes an inlet pipe 4*c*, and the tank body portion 4*b* of the outlet tank 42 includes an outlet pipe 4*d*. The hot coolant flows from the engine into the inlet tank 41 through the inlet pipe 4*c* to be cooled via heat exchange with air, and the cooled coolant flows out of the outlet tank 42 through the outlet pipe 4*d*.

Figure 2:
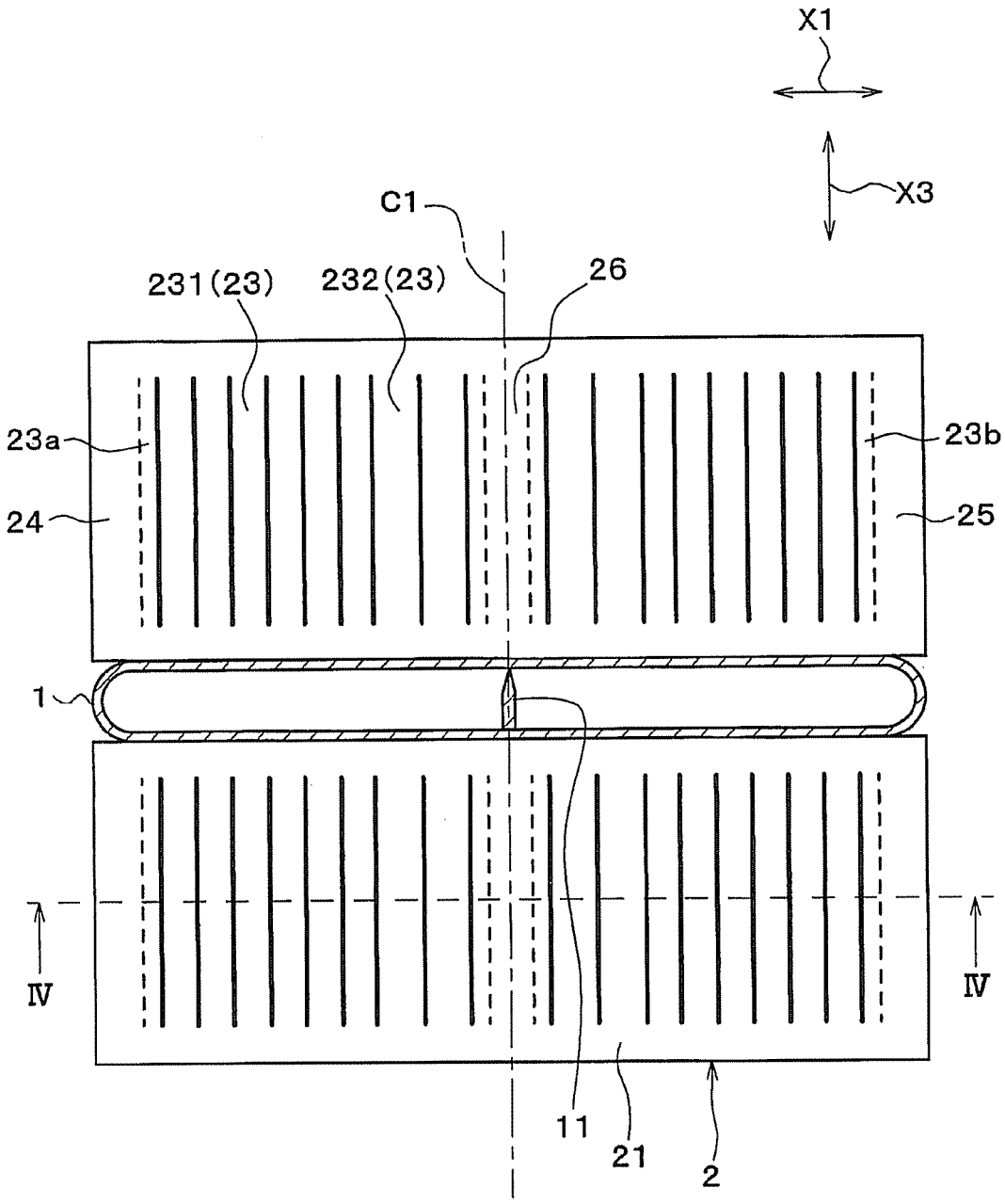
FIG. 2 is a sectional diagram taken along a line II-II of FIG. 1.

As shown in FIG. 2, the tube 1 includes an inner pole portion 11 located in an inside space of the tube 1. The inner pole portion 11 connects the flat walls 10*a* and 10*b* to increase a pressure capacity (strength) of the tube 1. The inner pole portion 11 is located at a center part of the inside space of the tube 1 in the air flow direction X1. The inner pole portion 11 partitions the inside space of the tube 1 into two spaces for fluid passages. The inner pole portion 11 may be used as an example of a pressure resistance part that is located the inside space of the tube 1 to ensure a pressure capacity of the tube 1.

Figure 3:
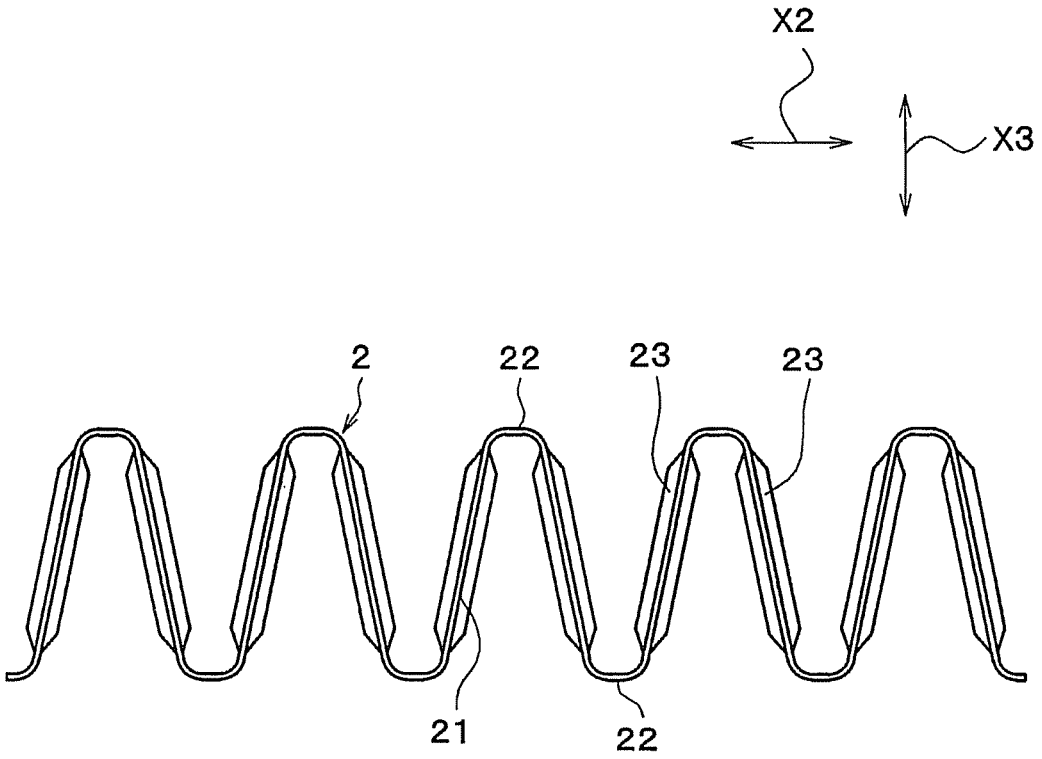
FIG. 3 is a view showing a fin of the radiator according to the first embodiment.

As shown in FIG. 3, the fin 2 includes multiple flat portions 21 (plate portions) having a plate-like shape, and multiple curved portions 22 (peak portions) connecting two of the flat portions 21. The flat portions 21 and the curved portions 22 are alternately arranged to be a corrugated shape as a whole. Thus, the flat portions 21 are arranged at predetermined intervals. Each flat portion 21 has a flat surface parallel to the air flow direction X1 (i.e., a direction perpendicular to a paper surface of FIG. 3). The flat portions 21 may be flat plates.

Each of the curved portions 22 includes a peak plate part having a flat plate shape. The peak plate part has a relatively small dimension in the tube longitudinal direction X2, as shown in FIG. 3. The peak plate part faces outward in a direction parallel to the tube stacking direction X3, in other words, the peak plate part is arranged to be perpendicular to the tube stacking direction X3. Each of the curved portions 22 further includes two curved parts that are located respectively on both sides of the peak plate part in the tube longitudinal direction X2. Each of the curved part is curved at an approximately right angle and is located between the flat portion 21 and the peak plate part of the curved portion 22, as shown in FIG. 3. The peak plate part of the curved portion 22 is connected to the tube 1, and the fin 2 is thereby connected to two of the tubes 1 adjacent to the fin 2 in the tube stacking direction X3. Accordingly, heat is transferable between the tubes 1 and fins 2. The dimension of the peak plate part of the curved portion 22 may be made to be sufficiently small, and a curvature of the curved part of the curved portion 22 may be made to be small, so that the curved portion 22 can be seen as a single curved shape as a whole.

The corrugated fin 2 is obtained by roll forming of a thin metallic plate member in the present embodiment, for example. The curved portions 22 of the fin 2 are connected to the flat walls 10*a* and 10*b* of the tube 1 by brazing, for example.

Figure 4:
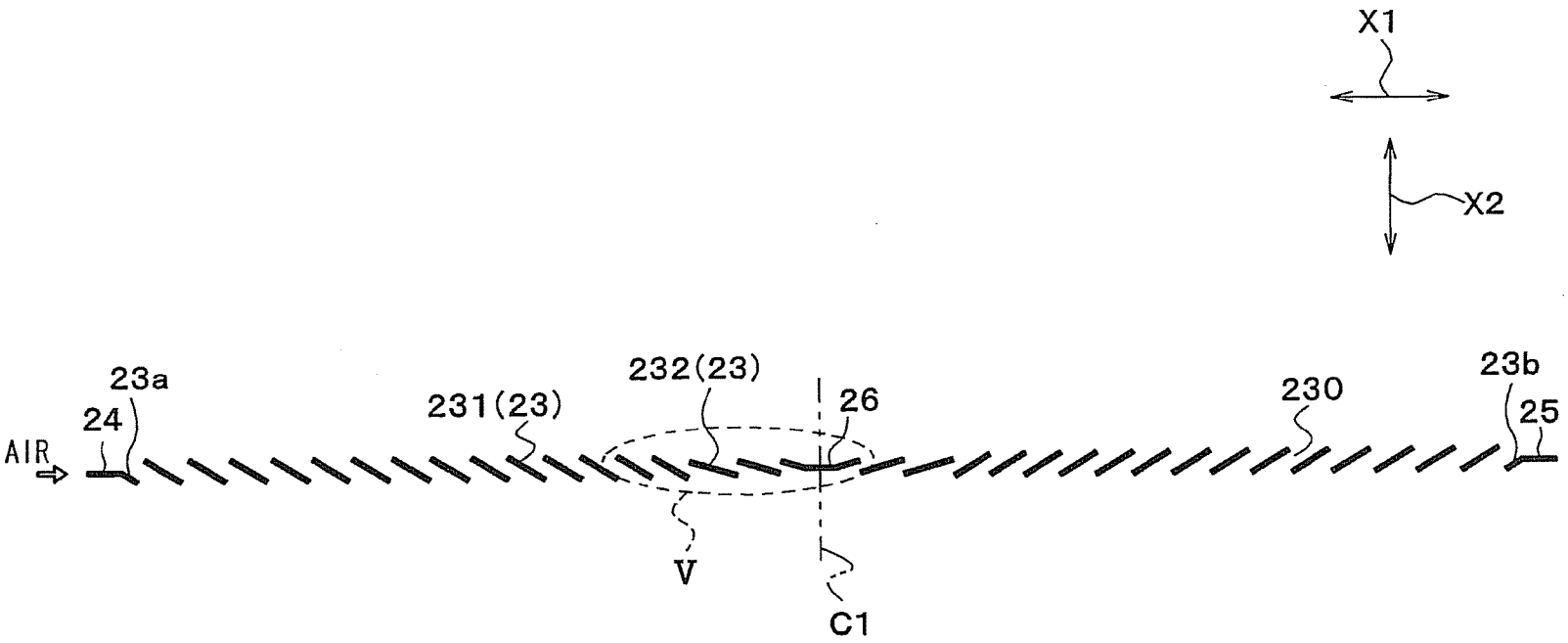
FIG. 4 is a sectional diagram taken along a line IV-IV of FIG. 2.
Figure 5:
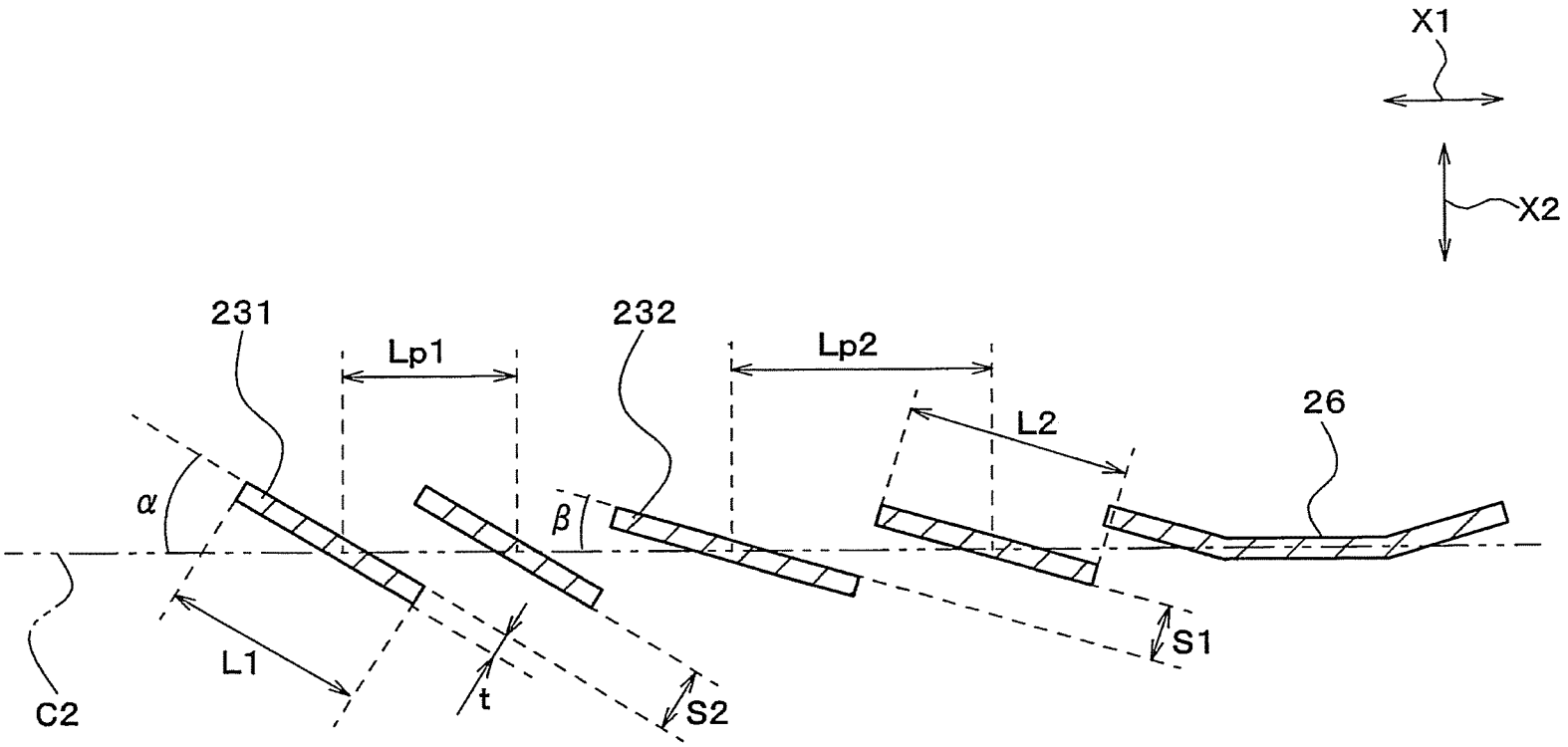
FIG. 5 is an enlarged view showing a part V of FIG. 4.

As shown in FIG. 4, the fin 2 further includes multiple louvers 23 integrated with the flat portion 21. Each of the multiple louvers 23 is obtained by cutting a part of the flat portion 21 and raising the cut part from the flat portion 21 with keeping connection between the cut part and the flat portion 21. In other words, the louvers 23 are inclined from the flat portion 21 at a predetermined inclined angle when the louvers 23 are viewed in the tube stacking direction X3 as shown in FIGS. 4 and 5. More specifically, upstream ends of the louvers 23 in the air flow direction X1 are located on one side of the flat portion 21, and downstream ends of the louvers 23 in the air flow direction X1 are located on the other side of the flat portion 21. The multiple louvers 23 are arranged in the air flow direction X1. A louver passage 230 is provided between each two louvers 23 adjacent to each other, so that air is capable of flowing through the louver passage 230.

In the present embodiment, the multiple louvers 23 provided in each of the flat portion 21 are separated into an upstream louver group and a downstream louver group. The upstream louver group are located upstream of the downstream louver group in the air flow direction X1. The upstream louver group is different from the downstream louver group in an inclination direction (raising direction) of the louvers 23. The louvers 23 of the upstream louver group are inclined from the flat portion 21 in an inclination direction opposite from an inclination direction in which the louvers 23 of the downstream louver group are inclined from the flat portion 21. In other words, as shown in FIG. 4, the upstream ends of the louvers 23 of the upstream louver group are located on a side of the flat portion 21 opposite from a side on which the upstream ends of the louvers 23 of the downstream louver group are located.

An upstream end part of the flat portion 21 in the air flow direction X1 is an upstream flat part 24. The upstream flat part 24 is located on an upstream side of the upstream louver group in the air flow direction X1, in other words, any louver 23 is not provided in the upstream flat part 24. Similarly, a downstream end part of the flat portion 21 in the air flow direction X1 is a downstream flat part 25 where any louver 23 is not provided.

Additionally, there is no louver 23 in an approximately center part of the flat portion 21 in the air flow direction X1 (i.e., any louver 23 is not provided in a part between the upstream louver group and the downstream louver group). The approximately center part of the flat portion 21 is a changing part 26 where a flow direction of air flowing in vicinity of the flat portion 21 is changed. In other words, the changing part 26 is provided between the upstream and downstream louver groups, and is approximately parallel to the air flow direction X1. Hence, as described above, the inclination direction of the louver 23 is different between an upstream side of the changing part 26 and a downstream side of the changing part 26. The changing part 26 may be used as an example of a fluid-turning part that is arranged between two of the louvers 23 and has a surface approximately parallel to the air flow direction X1.

As shown in FIG. 4, an upstream end louver 23*a*, which is one of the louvers 23 located most upstream side in the air flow direction X1, is connected to the upstream flat part 24. A downstream end louver 23*b*, which is one of the louvers 23 located most downstream side in the air flow direction X1, is connected to the downstream flat part 25.

The numbers of louvers 23 in the upstream louver group is same as the number of louvers 23 in the downstream louver group. The louvers 23 of the flat portion 21 are arranged symmetrically against a center line C1 (imaginary line) of the flat portion 21 in the air flow direction X1 as shown in FIG. 4.

In FIG. 5, an alternate long and two short dashes line is a center line C2 (imaginary line) of the flat portion 21 in its thickness direction. As shown in FIGS. 4 and 5, two kinds of the louvers 23 are provided in the flat portion 21, and the two kinds of the louvers 23 are different from each other in louver pitch. The louver pitch is a distance between center points of two of the louvers 23 adjacent to each other. The two kinds of the louvers 23 are provided in both the upstream louver group and the downstream louver group.

The two kinds of the louvers 23 are referred to respectively as first louvers 231 and second louvers 232. The first louvers 231 are larger than the second louvers 232 in the inclined angle. A first inclined angle α of the first louver 231 is larger than a second inclined angle β of the second louver 232 as shown in FIG. 5. The second louvers 232 are nearer to the changing part 26 than the first louvers 231 are. The second louvers 232 are arranged to be adjacent to the changing part 26.

As described above, the changing part 26 is arranged at the center part of the flat portion 21 of the fin 2 in the air flow direction X1 as shown in FIG. 2. Additionally, the inner pole portion 11 is arranged at the center part of the inside space of the tube 1 in the air flow direction X1. Because the second louvers 232 are arranged to be adjacent to the changing part 26, the second louvers 232 are located in vicinity to the center part of the flat portion 21 of the fin 2. Thus, the second louvers 232 can be said to be located at positions corresponding to a position of the inner pole portion 11. In other words, distances from the second louvers 232 to the inner pole portion 11 are shorter than distances from the first louvers 231 to the inner pole portion 11.

In FIG. 5, a louver pitch Lp2 of the second louvers 232 is set larger than a louver pitch Lp1 of the first louvers 231. In other words, a louver length L2 of the second louver 232 is longer than a louver length L1 of the first louvers 231.

In each flat portion 21 of the fin 2, louver distances between every two louvers 23 adjacent to each other is constant. In other words, a louver distance S1 between two of the first louvers 231 adjacent to each other is set to be approximately equal to a louver distance S2 between two of the second louvers 232 adjacent to each other. The louver distance is a length of a line perpendicularly connecting surfaces of two of the louvers 23 which are adjacent and parallel to each other. Hence, flow rates of air flowing into the multiple louver passages 230 provided in the flat portion 21 can be set at approximately the same, and the air is capable of flowing through the louver passages 230 smoothly. As a result, heat radiation capacity of the radiator can be increased.

In the present embodiment, "same" and "equal" used in explanation of structure mean not only "perfectly coincident", but also "slightly different" due to manufacturing error and assembling error.

Figure 6:
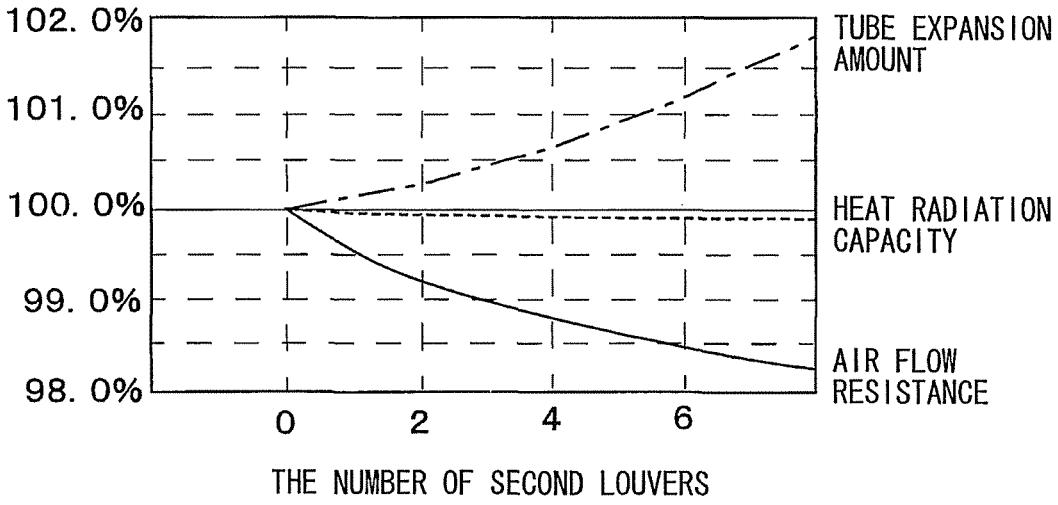
FIG. 6 is a characteristic diagram showing a heat radiation capacity, a tube expansion amount and an airflow resistance dependent on the number of second louvers, according to the first embodiment.

FIG. 6 shows a relationship between the number of the second louvers 232 and the performance and the pressure capacity of the radiator. In FIG. 6, a solid curve line shows a percentage of an airflow resistance in the fin 2 when the percentage of the airflow resistance is 100% in a case where the number of the second louvers 232 is zero. A dash curve line shows a percentage of a heat radiation capacity of the fin 2 when the percentage of the heat radiation capacity is 100% in the case where the number of the second louvers 232 is zero. An alternate long and dash curve line shows a percentage of an expansion amount of the tubes 1 when the percentage of the expansion amount is 100% in the case where the number of the second louvers 232 is zero.

An abscissa axis of FIG. 6 shows the number of the second louvers 232 provided in each of the upstream louver group and the downstream louver group. For example, when the number of the second louvers 232 is two in FIG. 6, the upstream louver group and the downstream louver group respectively have two second louvers 232, in other words, four second louvers 232 are provided in each flat portion 21 of the fin 2.

As shown in FIG. 6, when the number of the second louvers 232 is increased, the heat radiation capacity of the fin 2 changes little, and the airflow resistance changes greatly. Hence, when the number of the second louvers 232 is increased, the heat radiation capacity of the radiator increases as a whole. On the other hand, the expansion amount of the tubes 1 increases when the number of the second louvers 232 is increased. Therefore, the pressure resistance of the fin 2 may decrease, and a force pressing the tubes 1 from outside may decrease, in accordance with the increase of the number of the second louvers 232.

Therefore, in the present embodiment, the number of the second louvers 232 is set at two, and the number of the first louvers 231 is set at thirteen in each of the upstream louver group and the downstream louver group. Accordingly, the heat radiation capacity can be increased while the decrease of the pressure resistance is limited.

In the present embodiment, the second louvers 232 have the inclined angle smaller than that of the first louvers 231, and are arranged to be adjacent to the changing part 26. Thus, a pressure loss can be decreased when an air flow direction is changed in the changing part 26. Accordingly, a flow rate of air flowing into an immediately-downstream air passage can be increased. The immediately-downstream air passage is provided between the changing part 26 and a second louvers 232 located immediately downstream of the changing part 26 in the air flow direction X1. Furthermore, because the second louver 232 located immediately downstream of the changing part 26 can be utilized effectively, a heat transfer efficiency of the fin 2 can be increased due to an edge effect of the second louver 232. Consequently, a heat radiation capacity can be increased, and a heat exchange capacity can be increased.

A second area moment I of the second louvers 232 calculated by using a following formula F1 can be increased by setting the louver pitch Lp2 of the second louvers 232 larger than the louver pitch Lp1 of the first louvers 231. Thus, the pressure resistance of the second louvers 232 can be increased. On the other hand, the pressure resistance of the second louvers 232 may decrease because the inclined angle of the second louvers 232 is smaller than that of the first louvers 231. However, because the second louvers 232 are arranged at the positions corresponding to the position of the inner pole portion 11 that enhances the pressure capacity (strength) of the tube 1, the pressure resistance can be increased as a whole.

$$I=(t\times L)/12\times(t^2\times\cos^2\theta+L^2\times\sin^2\theta)\approx 1/12\times t\times L^3\times\sin^2\theta \quad \text{(F1)}$$

where, t is a thickness of the louver 23 as shown in FIG. 5, L is a length of the louver 23 corresponding to L1 or L2 shown in FIG. 5, and θ is an inclined angle of the louver 23 corresponding to α or β shown in FIG. 5. The above-described formula F1 is true when the thickness t of the louver 23 is sufficiently smaller than the length L of the louver 23.

Accordingly, in the heat exchanger of the present embodiment, the heat exchange capacity can be increased, and the pressure resistance can be ensured.

Second Embodiment

A second embodiment of the present disclosure will be described in reference to FIGS. 7 and 8. In comparison with the first embodiment, arrangements of the changing part and the inner pole portion are changed in the second embodiment.

Figure 7:
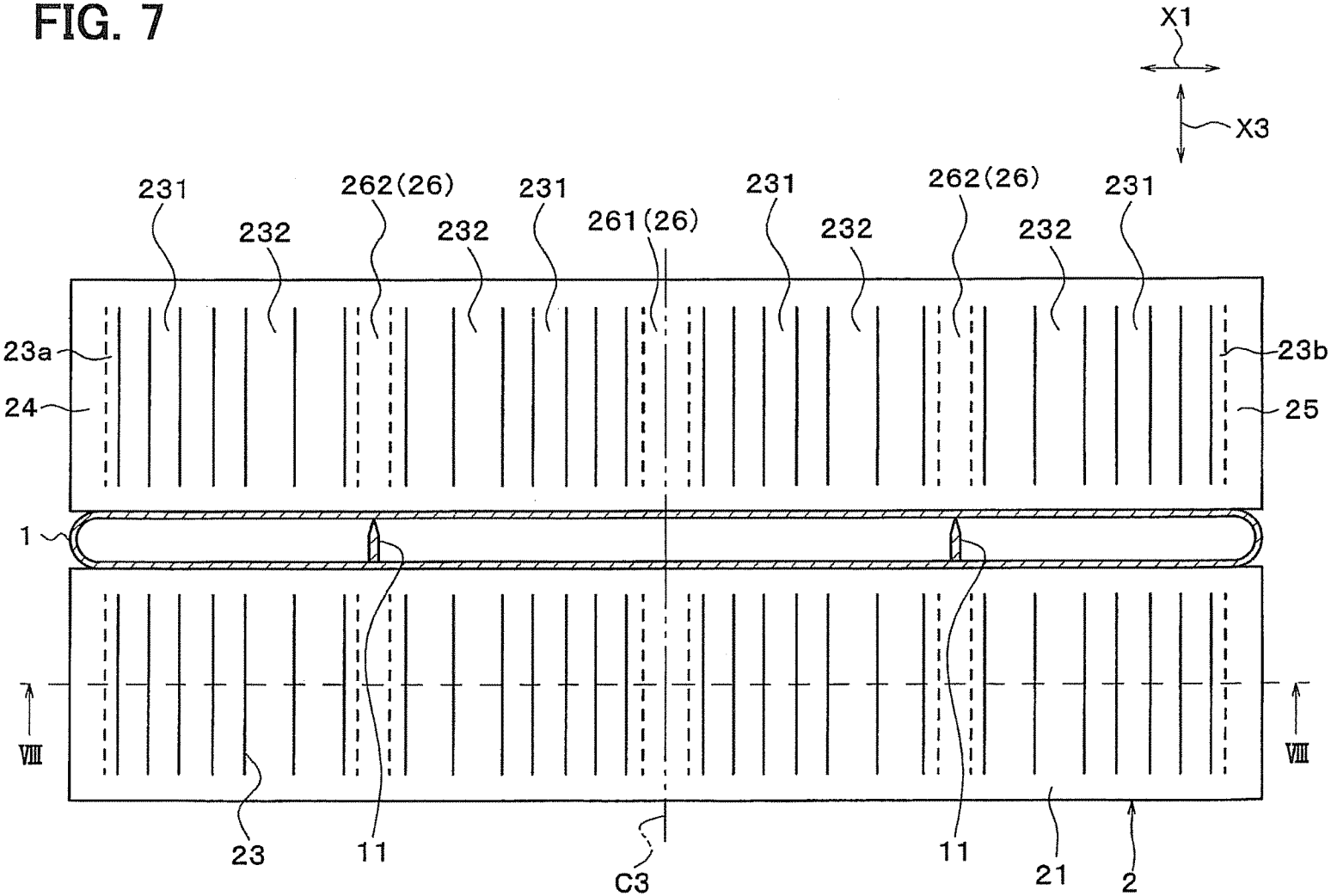
FIG. 7 is a sectional diagram showing a tube and fins when the tube and fins are viewed in a tube longitudinal direction, according to a second embodiment of the present disclosure.
Figure 8:
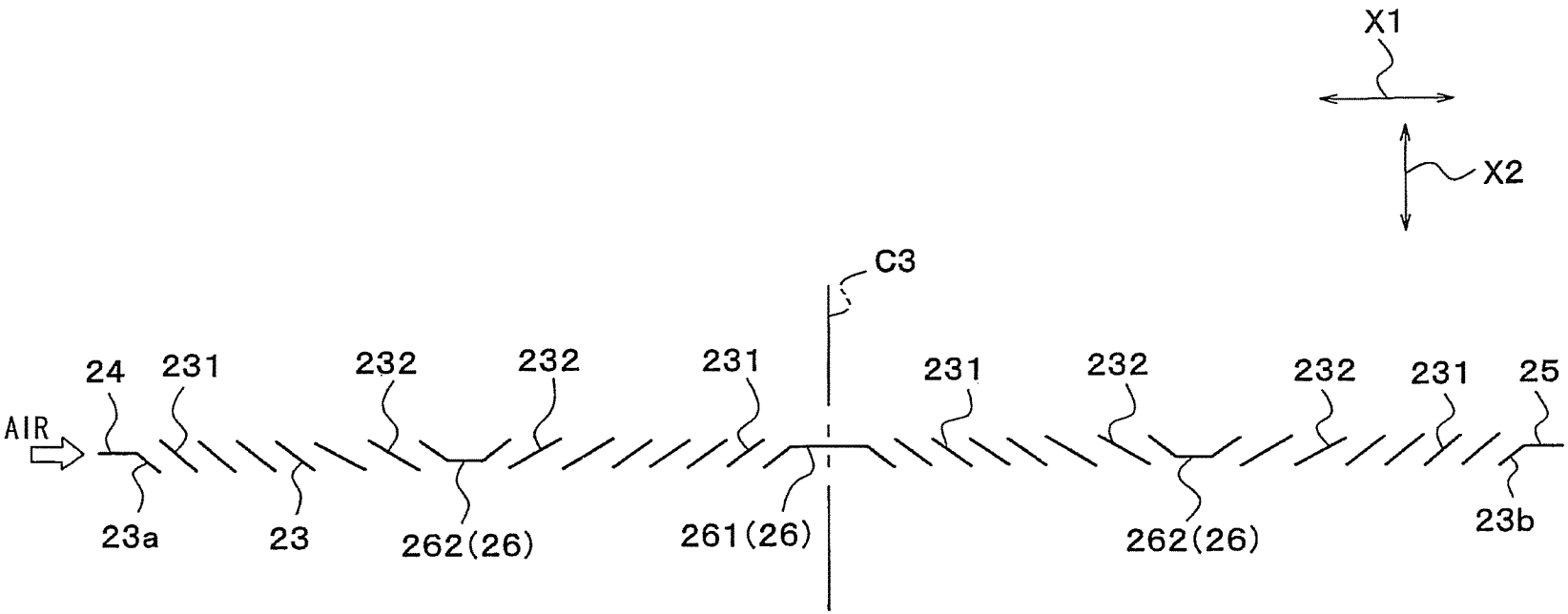
FIG. 8 is a sectional diagram taken along a line VIII-VIII of FIG. 7.

As shown in FIGS. 7 and 8, three changing part 26 are provided in each flat portion 21 of each fin 2 in the second embodiment. One of the three changing part 26 arranged at a center part of the flat portion 21 in an air flow direction X1 is referred to as a center changing part 261, and the other two of the three changing part 26 arranged between the center part and two end parts in the air flow direction X1 are referred to as side changing parts 262.

Multiple louvers 23 are provided in each flat portion 21, and the number of the louvers 23 on an upstream side of the center part 261 in the air flow direction X1 is same as the number of the louvers 23 on a downstream side of the center changing part 261 in the air flow direction X1. Additionally, the multiple louvers 23 are arranged symmetrically against a center line C3 (imaginary line) of the flat portion 21 in the air flow direction X1. The center line C3 extends on an imaginary surface perpendicular to the air flow direction X1.

Second louvers 232 are arranged to be nearer to the side changing parts 262 than first louvers 231 are. The second louvers 232 are arranged to be adjacent to the side changing parts 231. The first louvers 232 are arranged to be adjacent to an upstream flat part 24, a downstream flat part 25 and the center changing part 261.

As shown in FIG. 7, two inner pole portions 11 are provided in an inside space of each tube 1 in the present embodiment. The two inner pole portions 11 divide the inside space of the tube 1 into three spaces. The two inner pole portions 11 are located at positions corresponding to positions of the side changing parts 262. Because the second louvers 232 are adjacent to the side changing parts 262 as described above, the second louvers 232 are arranged at positions corresponding to the positions of the side changing parts 262.

In the second embodiment, similar effects to the first embodiment can be obtained.

Third Embodiment

A third embodiment of the present disclosure will be described referring to FIG. 9. In comparison with the first embodiment, a structure of tubes 1 is different in the third embodiment.

Figure 9:
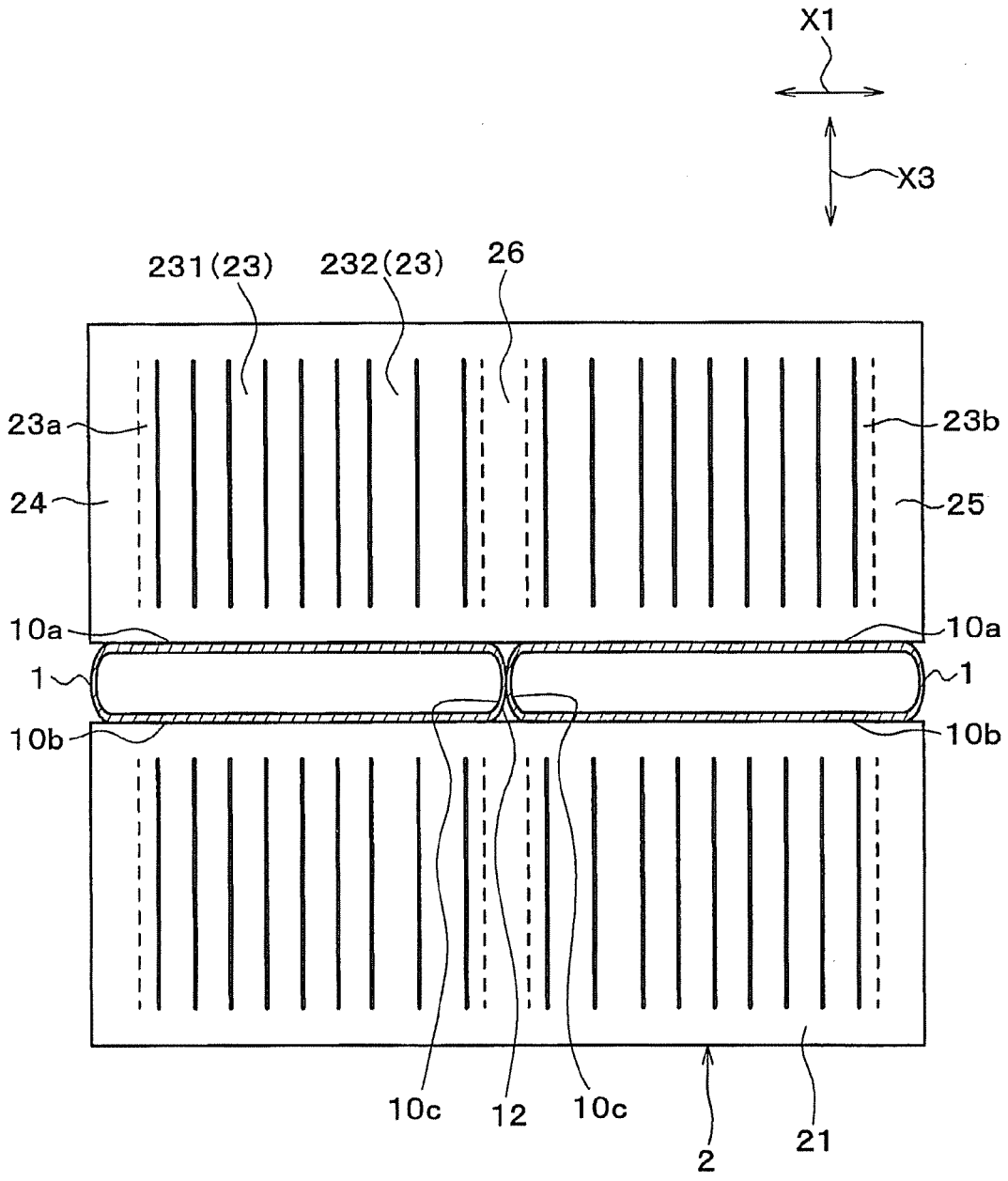
FIG. 9 is a sectional diagram showing tubes and fins according to a third embodiment of the present disclosure.

As shown in FIG. 9, in a radiator of the third embodiment, two tubes 1 are arranged in an air flow direction X2 between every two of fins 2 adjacent to each other. Each tube 1 includes a curved wall 10*c* that connects a flat wall 10*a* and a flat wall 10*b* of the tube 1, and the curved wall 10*c* protrudes outward in the air flow direction X1.

The curved walls 10*c* of the two tubes 1 arranged in the air flow direction X1 contact each other, and, the two tubes 1 contact two fins 2 located on both sides of the two tubes 1 in a tube stacking direction X3.

In the radiator of the present embodiment, the part where the two curved walls 10*c* of the two tubes 1 contact each other is referred to as a tube contact part 12 hereinafter, and the tube contact part 12 increases a pressure capacity of the two tubes 1. The tube contact part 12 may be used as an example of the pressure resistance part that ensures the pressure capacity of the tube 1.

In each fin 2, a changing part 26 is arranged at a center part of a flat portion 21 in the air flow direction X1. Hence, second louvers 232 adjacent to the changing part 26 are located near the center part of the flat portion 21 of each fin 2 in the air flow direction X1. Therefore, it can be said that the second louvers 232 are located at positions corresponding to a position of the tube contact part 12. In other words, distances from the second louvers 232 to the changing part 26 is shorter than distances from the first louvers 231 to the changing part 26.

In the third embodiment, similar effects to the first embodiment can be obtained.

Although the present disclosure has been fully described in connection with the preferred embodiments thereof with reference to the accompanying drawings, it is to be noted that various changes and modifications will become apparent to those skilled in the art. The present disclosure is not limited to the above-described embodiments, and can be changed variedly as described below without departing from the scope of the present disclosure.

In the above-described embodiments, the tubes 1 are used as the heat-exchange object, and the heat exchanger is a kind of a heat exchanger having tubes and fins. However, the heat-exchange object and the heat exchanger are not limited to the above. For example, an electronic member or a machinery which generates heat, such as a power card (Power Control Unit: PCU) and an inverter element, may be used as the heat-exchange object. Additionally, the heat exchanger may be a heat exchanger having a structure in which the electronic member is directly connected to the fin.

In the above-described embodiments, the radiator is used as the heat exchanger, but the heat exchanger is not limited to the radiator. For example, a condenser which cools a refrigerant circulating in a vehicle refrigerant cycle (air conditioner) via heat exchange with air may be used as the heat exchanger. Alternatively, an intercooler which cools air (intake air) supplied to an internal combustion engine may be used as the heat exchanger.

In the above-described embodiments, the louvers 23 are provided in each fin 2 (outer fin) connected to the outer surface of the tube 1. However, the louvers 23 may be provided in an inner fin arranged inside the tube 1.

In the first and second embodiments, the inner pole portion 11 connects the two flat walls 10*a* and 10*b* of the tube 1. However, the inner pole portion 11 may extend from the flat wall 10*a* toward the flat wall 10*b*, and may be not connected to the flat wall 10*b*. In other words, the inner pole portion 11 may be located such that a one end part of the inner pole portion 11 is connected to the flat wall 10*a*, and the other end part of the inner pole portion 11 is separated from the flat wall 10*b*.

In the above-described embodiments, the changing part 26 is provided in each flat portion 21 of each fin 2. However, the changing part 26 may be omitted. Even in this case, the pressure capacity can be ensured as a whole by locating the second louvers 232 at positions corresponding to the position of the pressure resistance part (e.g., the inner pole portion 11 or the tube contact part 12) that increases the pressure capacity of the tubes 1.

Additional advantages and modifications will readily occur to those skilled in the art. The disclosure in its broader terms is therefore not limited to the specific details, representative apparatus, and illustrative examples shown and described.

What is claimed is:

1. A fin for a heat exchanger in which the fin is connected to an outer surface of a heat-exchange object to promote heat exchange between the heat-exchange object and fluid flowing in the vicinity of the heat-exchange object, the fin comprising:

a flat portion having a flat shape approximately parallel to a flow direction of the fluid, the flat portion includes an upstream flat part located on an upstream-most end part of the flat portion in the flow direction of the fluid and a downstream flat part located on a downstream-most end part of the flat portion in the flow direction of the fluid;

a plurality of louvers cut and inclined from the flat portion, the plurality of louvers being arranged in the flow direction of the fluid; and a fluid-turning part arranged between two of the plurality of louvers adjacent to each other, the fluid-turning part having a flat plate approximately parallel to the flow direction of the fluid, wherein the plurality of louvers are separated into an upstream group located upstream of the fluid-turning part in the flow direction of the fluid, and a downstream group located downstream of the fluid-turning part in the flow direction of the fluid, the louvers of the upstream group are inclined from the flat portion in an inclination direction opposite from an inclination direction in which the louvers of the downstream group are inclined from the flat portion, and wherein at least one of the plurality of the louvers of the upstream group include at least a first set of louvers and a second set of louvers, wherein the first set of louvers consists of all of the louvers immediately downstream of the upstream flat part and immediately upstream of the second set of louvers, and the second set of louvers consist of all the louvers immediately downstream of the first set of louvers and immediately upstream of the fluid-turning part in the fluid flow direction; wherein a first louver in the first set of louvers is directly connected to the upstream flat part; each of the louvers in the first set of louvers is larger in inclination angle from the flat portion than all the louvers in the second set of louvers; or the plurality of the louvers of the downstream group include at least a third set of louvers and a fourth set of louvers, wherein the third set of louvers consists of all of the louvers immediately downstream the fluid-turning part and immediately upstream of the fourth set of louvers, and the fourth set of louvers consist of all the louvers immediately downstream of the third set of louvers and immediately upstream of the downstream flat part in the fluid flow direction, said fourth set of louvers including a last louver that is directly connected to the downstream flat part; wherein each of the louvers in the third set of louvers is smaller in inclination angle from the flat portion than all the louvers in the fourth set of louvers.

2. The fin according to claim 1, wherein the second set of louvers are larger than the first set of louvers in louver pitch.

3. The fin according to claim 2, wherein the first set of louvers are approximately equal to the second set of louvers in louver distance.

4. The fin according to claim 1, wherein the second set of louvers includes two louvers and the first set of louvers includes thirteen louvers, and the third set of louvers includes two louvers and the fourth set of louvers includes thirteen louvers.

5. The fin according to claim 1, wherein a first inclination angle from the flat portion of each of the louvers in the first set of louvers is the same; and a second inclination angle from the flat portion of each of the louvers in the second set of louvers is the same; the first inclination angle being larger than the second inclination angle; and wherein all the louvers in the third set of louvers are inclined at the second inclination angle from the flat portion, and wherein all the louvers in the fourth set of louvers are inclined at the first inclination angle from the flat portion.

6. A heat exchanger comprising;

a tube through which an internal fluid flows; and a fin connected to an outer surface of the tube to promote heat exchange between the internal fluid and an external fluid flowing in the vicinity of the tube, wherein the tube includes a pressure resistance part located at an inside space of the tube to ensure a pressure resistance of the tube, the fin includes:

a flat portion having a flat shape approximately parallel to a flow direction of the external fluid, the flat portion includes an upstream flat part located on an upstream-most end part of the flat portion in the flow direction of the external fluid and a downstream flat part located on a downstream-most end part of the flat portion in the flow direction of the external fluid;

a plurality of louvers cut and inclined from the flat portion, the plurality of louvers being arranged in the flow direction of the external fluid; and a fluid-turning part having a flat plate approximately parallel to the flow direction of the external fluid, the plurality of louvers include at least a first set of louvers and a second set of louvers, the plurality of louvers are separated into an upstream group located upstream of the fluid-turning part in the flow direction of the external fluid, and a downstream group located downstream of the fluid-turning part in the flow direction of the external fluid, and a last louver of the second set of louvers of the upstream group is connected directly to the fluid-turning part, and wherein at least one of the first set of louvers consists of all of the louvers immediately downstream of the upstream flat part and immediately upstream of the second set of louvers, and the second set of louvers consist of all the louvers immediately downstream of the first set of louvers and immediately upstream of the fluid-turning part in the external fluid flow direction; wherein a first louver in the first set of louvers is directly connected to the upstream flat part; each of the louvers in the first set of louvers is larger in inclination angle from the flat portion than all the louvers in the second set of louvers; or the plurality of the louvers of the downstream group include at least a third set of louvers and a fourth set of louvers, wherein the third set of louvers consists of all of the louvers immediately downstream the fluid-turning part and immediately upstream of the fourth set of louvers, and the fourth set of louvers consist of all the louvers immediately downstream of the third set of louvers and immediately upstream of the downstream flat part in the external fluid flow direction, said fourth set of louvers including a last louver that is directly connected to the downstream flat part; wherein each of the louvers in the third set of louvers is smaller in inclination angle from the flat portion than all the louvers in the fourth set of louvers.

7. The heat exchanger according to claim 6, wherein the fluid-turning part is arranged between two of the plurality of louvers adjacent to each other, the louvers of the upstream group are inclined from the flat portion in an inclination direction opposite from an inclination direction in which the louvers of the downstream group are inclined from the flat portion, and the second set of louvers are arranged adjacent to the fluid-turning part.

8. The heat exchanger according to claim 6, wherein the tube has a flattened shape in its cross-sectional surface perpendicular to a longitudinal direction of the tube, the tube includes two flat walls opposed to each other to be exposed to a flow passage of the tube through which the internal fluid flows, and the pressure resistance part is an inner pole portion which connects the two flat walls inside the tube.

9. The heat exchanger according to claim 6, wherein the pressure resistance part is positioned adjacent a center part of the flat portion in the flow direction of the external fluid.

10. The heat exchanger according to claim 6, wherein the pressure resistance part is positioned at a center part of the tube corresponding to a center part of the flat portion in the flow direction of the external fluid.

11. The heat exchanger according to claim 6, wherein a first inclination angle from the flat portion of each of the louvers in the first set of louvers is the same; and a second inclination angle from the flat portion of each of the louvers in the second set of louvers is the same; the first inclination angle being larger than the second inclination angle; and wherein all the louvers in the third set of louvers are inclined at the second inclination angle from the flat portion, and wherein all the louvers in the fourth set of louvers are inclined at the first inclination angle from the flat portion.

12. A fin for a heat exchanger in which the fin is connected to an outer surface of a heat-exchange object to promote heat exchange between the heat-exchange object and fluid flowing in the vicinity of the heat-exchange object, the fin comprising:

a flat portion having a flat shape approximately parallel to a flow direction of the fluid, the flat portion includes an upstream flat part located on an upstream-most end part of the flat portion in the flow direction of the fluid and a downstream flat part located on a downstream-most end part of the flat portion in the flow direction of the fluid;

a plurality of louvers cut and inclined from the flat portion, the plurality of louvers being arranged in the flow direction of the fluid; and a fluid-turning part arranged between two of the plurality of louvers adjacent to each other, the fluid-turning part having a flat plate approximately parallel to the flow direction of the fluid, wherein the plurality of louvers are separated into an upstream group located upstream of the fluid-turning part in the flow direction of the fluid, and a downstream group located downstream of the fluid-turning part in the flow direction of the fluid, the louvers of the upstream group are inclined from the flat portion in an inclination direction opposite from an inclination direction in which the louvers of the downstream group are inclined from the flat portion, the plurality of the louvers of the upstream group include at least a first set of louvers and a second set of louvers, wherein the first set of louvers consists of all of the louvers immediately downstream of the upstream flat part and immediately upstream of the second set of louvers, and the second set of louvers consist of all the louvers immediately downstream of the first set of louvers and immediately upstream of the fluid-turning part in the fluid flow direction; wherein a first louver in the first set of louvers is directly connected to the upstream flat part; each of the louvers in the first set of louvers is larger in inclination angle from the flat portion than all the louvers in the second set of louvers; or the plurality of the louvers of the downstream group include at least a third set of louvers and a fourth set of louvers, wherein the third set of louvers consists of all of the louvers immediately downstream the fluid-turning part and immediately upstream of the fourth set of louvers, and the fourth set of louvers consist of all the louvers immediately downstream of the third set of louvers and immediately upstream of the downstream flat part in the fluid flow direction, said fourth set of louvers including a last louver that is directly connected to the downstream flat part; wherein each of the louvers in the third set of louvers is smaller in inclination angle from the flat portion than all the louvers in the fourth set of louvers, and one of the plurality of louvers nearest to an upstream end louver is one of the first louvers, and one of the plurality of louvers nearest to the fluid-turning part is one of the second louvers.

13. A heat exchanger comprising;

a tube through which an internal fluid flows; and a fin connected to an outer surface of the tube to promote heat exchange between the internal fluid and an external fluid flowing in the vicinity of the tube, wherein the tube includes a pressure resistance part located at an inside space of the tube to ensure a pressure resistance of the tube, the fin includes:

a flat portion having a flat shape approximately parallel to a flow direction of the external fluid, the flat portion includes an upstream flat part located on an upstream-most end part of the flat portion in the flow direction of the external fluid and a downstream flat part located on a downstream-most end part of the flat portion in the flow direction of the external fluid;

a plurality of louvers cut and inclined from the flat portion, the plurality of louvers being arranged in the flow direction of the external fluid; and a fluid-turning part consisting of a flat plate approximately parallel to the flow direction of the external fluid, the plurality of louvers include at least a first set of louvers and a second set of louvers, wherein the first set of louvers consists of all of the louvers immediately downstream of the upstream flat part and immediately upstream of the second set of louvers, and the second set of louvers consist of all the louvers immediately downstream of the first set of louvers and immediately upstream of the fluid-turning part in the external fluid flow direction; wherein a first louver in the first set of louvers is directly connected to the upstream flat part; each of the louvers in the first set of louvers is larger in inclination angle from the flat portion than all the louvers in the second set of louvers; or the plurality of the louvers of the downstream group include at least a third set of louvers and a fourth set of louvers, wherein the third set of louvers consists of all of the louvers immediately downstream the fluid-turning part and immediately upstream of the fourth set of louvers, and the fourth set of louvers consist of all the louvers immediately downstream of the third set of louvers and immediately upstream of the downstream flat part in the external fluid flow direction, said fourth set of louvers including a last louver that is directly connected to the downstream flat part; wherein each of the louvers in the third set of louvers is smaller in inclination angle from the flat portion than all the louvers in the fourth set of louvers, and one of the plurality of louvers nearest to an upstream end louver is one of the first louvers, and one of the plurality of louvers nearest to the fluid-turning part is one of the second louvers.

* * * * *